US006966782B2

(12) United States Patent
Wang et al.

(10) Patent No.: US 6,966,782 B2
(45) Date of Patent: Nov. 22, 2005

(54) ADAPTER WHICH CAN SHIELD AN END OF AN ANTENNA TERMINAL WELDED ON A WIRELESS NETWORK CARD

(75) Inventors: Cheng-Kuo Wang, Hsin-Chu (TW); Chen-Hsiung Mo, Miao-Li Hsien (TW)

(73) Assignee: Micro-Star Int'l Co., Ltd., Jung-He (TW)

( * ) Notice: Subject to any disclaimer, the term of this patent is extended or adjusted under 35 U.S.C. 154(b) by 7 days.

(21) Appl. No.: 10/709,898

(22) Filed: Jun. 4, 2004

(65) Prior Publication Data

US 2005/0179601 A1 Aug. 18, 2005

(30) Foreign Application Priority Data

Feb. 13, 2004 (TW) ..... 93103576 A

(51) Int. Cl.[7] ..... H01R 9/09; H01R 29/00
(52) U.S. Cl. ..... 439/65; 439/168; 439/169
(58) Field of Search ..... 439/168–169, 439/65; 343/702, 841, 906; 361/775, 683

(56) References Cited

U.S. PATENT DOCUMENTS

| | | | | |
|---|---|---|---|---|
| 6,527,562 | B2 * | 3/2003 | Tanaka et al. | 439/65 |
| 6,574,115 | B2 * | 6/2003 | Asano et al. | 361/775 |
| 6,847,330 | B2 * | 1/2005 | Rada et al. | 343/702 |
| 2003/0099088 | A1 * | 5/2003 | Yang et al. | 361/683 |
| 2003/0124985 | A1 * | 7/2003 | Shin et al. | 455/82 |
| 2004/0130014 | A1 * | 7/2004 | Nakamura | 257/678 |
| 2004/0257284 | A1 * | 12/2004 | Rada et al. | 343/702 |
| 2005/0003872 | A1 * | 1/2005 | Rada | 455/575.7 |

* cited by examiner

*Primary Examiner*—Thuy V. Tran
*Assistant Examiner*—Hung Tran Vy

(57) ABSTRACT

An adapter includes a wireless card, and a bracket fixed on the wireless card. The bracket includes a base plate that has an aperture for positioning an antenna terminal, and a mask extended from the base plate for substantially shielding an end of the antenna terminal welded on the wireless LAN card inside the mask.

8 Claims, 8 Drawing Sheets

ADAPTER WHICH CAN SHIELD AN END OF AN ANTENNA TERMINAL WELDED ON A WIRELESS NETWORK CARD

BACKGROUND OF INVENTION

1. Field of the Invention

The present invention relates to an adapter, and more particularly, to an adapter which can shield an end of an antenna terminal welded on a wireless LAN card.

2. Description of the Prior Art

Because of the Federal Communications Commission (FCC) Part 15.203, WLAN PCI adapters according to IEEE 802.11b and 802.11g must use nonstandard connections. Therefore, reverse SMA connections are widely used for wireless communication products with 2.4 GHz bandwidth. However, use of the 5.15~5.25 GHz band is limited due to FCC15.407-d regarding unlicensed national information infrastructure (U-NII) devices: "Any U-NII device that operates in 5.15~5.25 GHz band shall use a transmitting antenna that is an integral part of the device." That is, users of such device are prohibited from removing the antenna as they wish. Devices no complying with FCC15.407-d are prevented from using the 5.15~5.25 GHz band. There are many existing adapters for wireless network cards using RSMA connections that do not comply with FCC15.407-d, and these adaptors must close the 5.15~5.25 GHz band. Some manufacturers add quite a large mask for complying with FCC15.407-d at significant cost.

Please refer to FIG. 1 and FIG. 2. FIG. 1 and FIG. 2 show an adapter 10 according to the prior art. The adapter 10 includes a wireless LAN card 30 and a bracket 20. The bracket 20 includes a base plate 22 that has an aperture 24 for positioning an antenna terminal 25, and two fixing components 26 extended from the base plate 22 for firmly positioning the bracket 20 on the wireless LAN card 30. The antenna terminal 25 is positioned on the base plate 22 of the bracket 20 through the aperture 24 of the bracket 20, as shown in FIG. 2. A user can easily remove the antenna terminal 25 through the aperture 24 as they wish resulting in the adaptor 10 not complying with FCC15.407-d. Therefore, the design of the adapter 10 results in wireless LAN communication products not being able to use all the bandwidth of IEEE 802.11a.

Please refer to FIG. 3. FIG. 3 shows an adapter 40 that has a mask 46 on the wireless LAN card 30. The wireless LAN card 30 includes a mini wireless card (mini PCI) 42. In FIG. 3, the antenna is positioned on a connection 43 of the mini PCI 42 through a cable 44. To comply with FCC15.407-d, the connection 46 must be hidden inside the mask 46 so that users cannot easily remove the antenna. The prior art uses the mask 46 to shield the connection 43 and the mini PCI 42. However, this increases the cost and wastes material. To addition, due to the long distance between the mini PCI 42 and the base plate 22, the mask 46 is positioned far from the base plate 22. The length of the cable 44 is required to be from the base plate 22 to the connection 43. This wastes the space in the wireless LAN card 30 and also wastes material. Additionally, it is difficult to make the mask 46 extend from the base plate 22 to the mini PCI 42.

SUMMARY OF INVENTION

It is therefore a primary objective of the claimed invention to provide an adapter, which can shield an antenna terminal, welded on a wireless LAN card.

The present invention discloses an adapter including a wireless LAN card, and a bracket fixed on the LAN wireless card. The bracket includes a base plate that has an aperture for positioning an antenna terminal, and a mask extended from the base plate for substantially shielding an end of the antenna terminal welded on the wireless LAN card inside the mask.

These and other objectives of the present invention will no doubt become obvious to those of ordinary skill in the art after reading the following detailed description of the preferred embodiment that is illustrated in the various figures and drawings.

DETAILED DESCRIPTION

Figure 4:
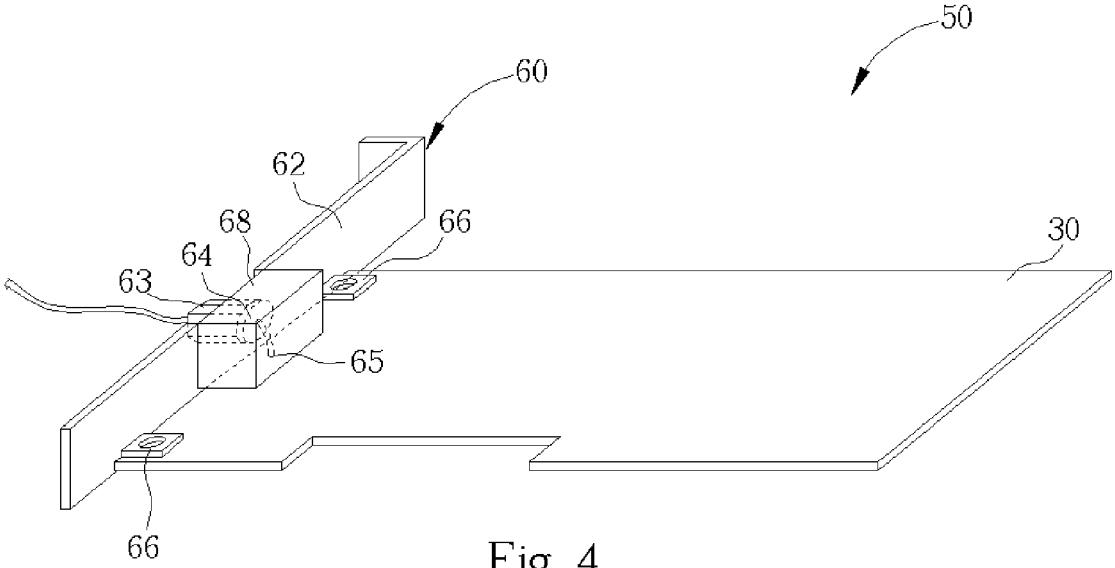
FIG. 4 is a diagram of an adapter according to the present invention.

Please refer to FIG. 4. FIG. 4 shows an adapter 50 according to the present invention. In this embodiment, the circuit of the prior art mini PCI 42 is also laid out on the wireless LAN card 30. Therefore, an antenna terminal 63 is welded onto the wireless LAN card 30, not onto the mini PCI 42. Additionally, a bracket 60 of the present invention is modified from the bracket 20, as shown in FIG. 4. A square mask 68 is extended from a base plate 62, and can be extended for shielding the antenna terminal 63 on a welded end 65 of the wireless LAN card 30 to prevent short circuits when fabricating or using. Therefore, the adaptor 50 can comply with FCC15.407-d in that "A transmitting antenna is an integral part of the device," and prevent users from being hurt when repairing or changing the antenna.

Figure 5:
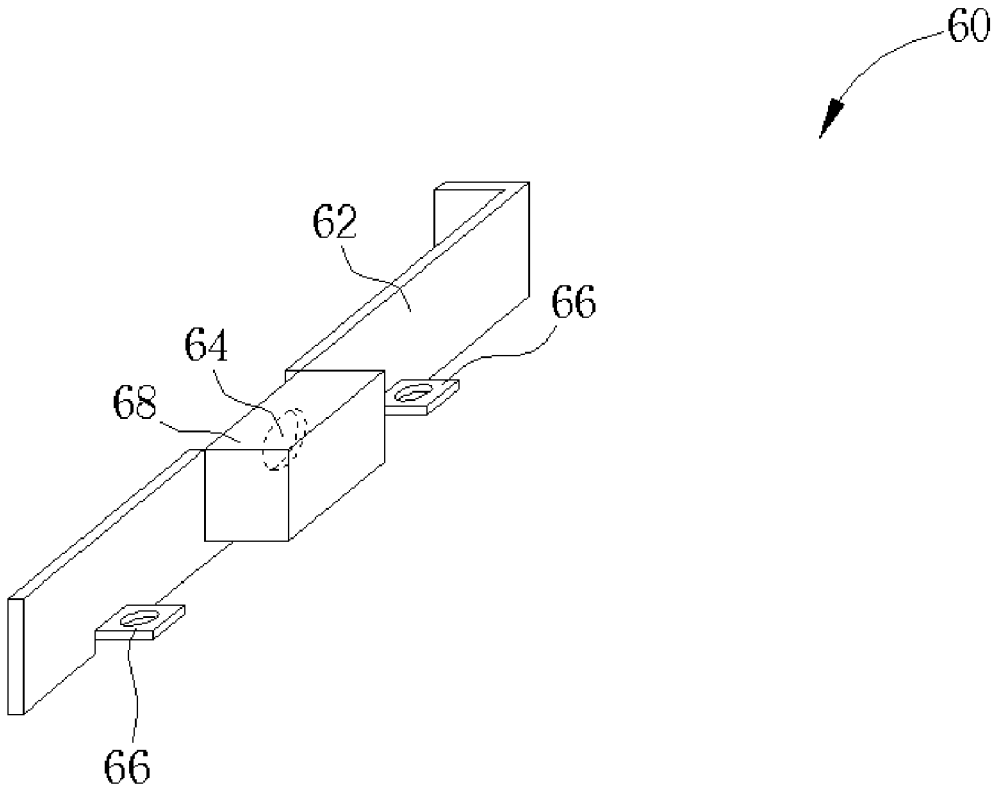
FIGS. 5 to 8 show different brackets according to the present invention.

Please refer to FIG. 5. FIG. 5 shows the bracket 60 of the present invention. The bracket 60 includes the base plate 62 that has an aperture 64 for positioning the antenna terminal 63, the mask 68 extended from the base plate 62 for substantially shielding an end of the antenna terminal 62 welded on the wireless LAN card 30 inside the mask 68, and two fixing components 66 extended from the base plate 62 for firmly positioning the bracket 60 onto the wireless LAN card 30.

Figure 6:
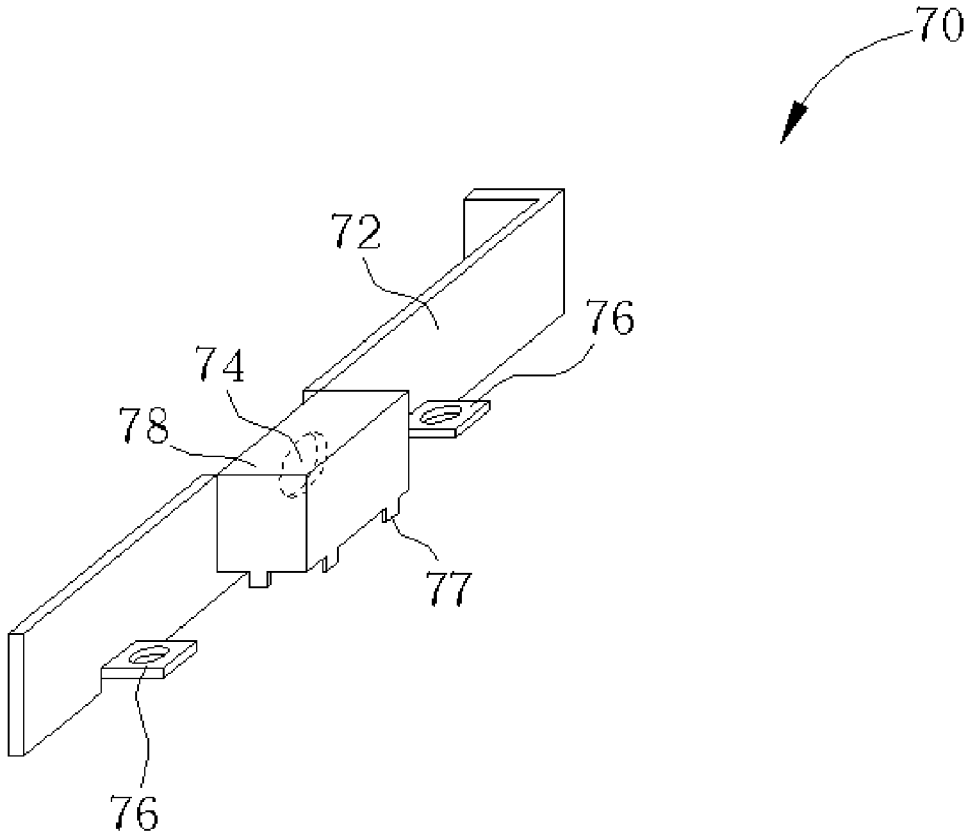

Please refer to FIG. 6. FIG. 6 shows another bracket 70 according to the present invention. The bracket 70 comprises a base 72, an aperture 74 and two fixing components 76. The difference between the bracket 70 and the bracket 60 in FIG. 5 is that a mask 78 includes a plurality of locating elements 77 that can fix the bracket 70 onto the wireless LAN card 30 for making the fabrication and use of the bracket 70 and the wireless LAN card 30 securer. Remove protect tabs can also be used for preventing removal.

Figure 7:
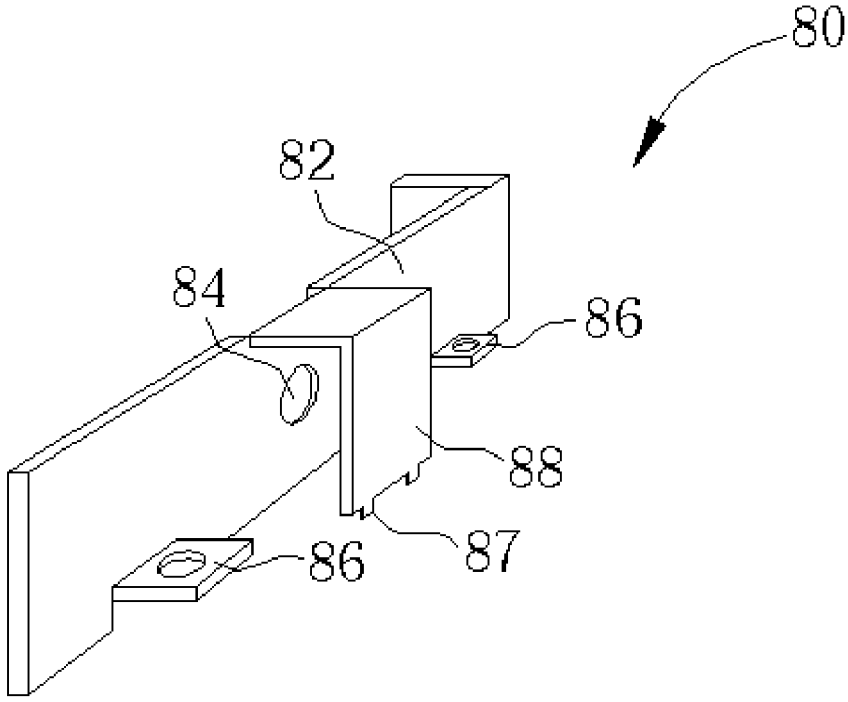
Figure 8:
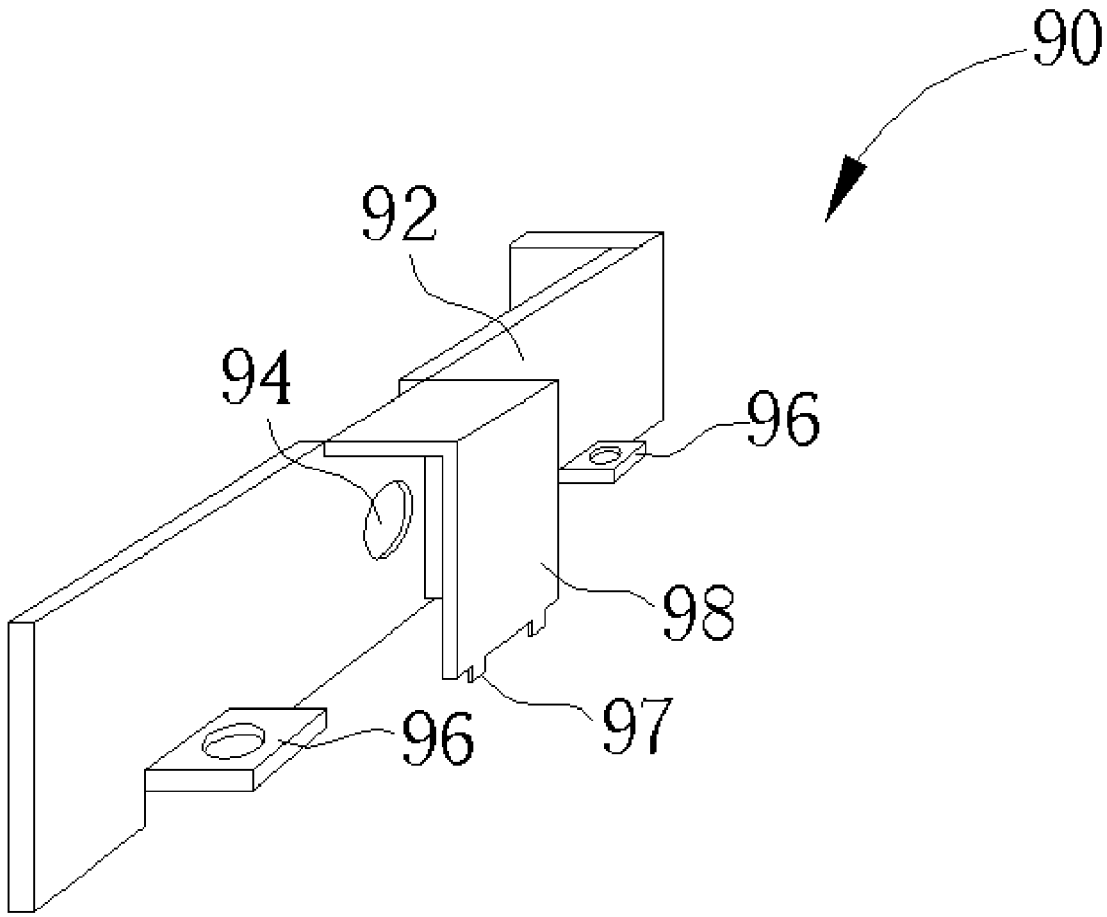

Please refer to FIG. 7 and FIG. 8. FIG. 7 and FIG. 8 show two brackets 80 and 90 according to the present invention. The bracket 80 comprises a base 82, an aperture 84, two fixing components 86, and a plurality of locating elements 87, and the bracket 90 comprises a base 92, an aperture 94, two fixing components 96, and a plurality of locating elements 97. The difference from the bracket 60 is that masks 88 and 98 lack one or two sides (i.e. have simplified structure), as shown in FIG. 7 and FIG. 8. This makes it convenient for an operator to check the elements inside the masks 88 and 98 or the welded ends with the naked eye. The masks 88 and 98 of the bracket 80 and 90 are respectively extended from base plates 82 and 92 for substantially shielding the end of the antenna terminal 63 on the wireless LAN card 30 inside the masks 88 and 98. This also prevents users from being hurt when repairing or changing the antenna.

Figure 1:
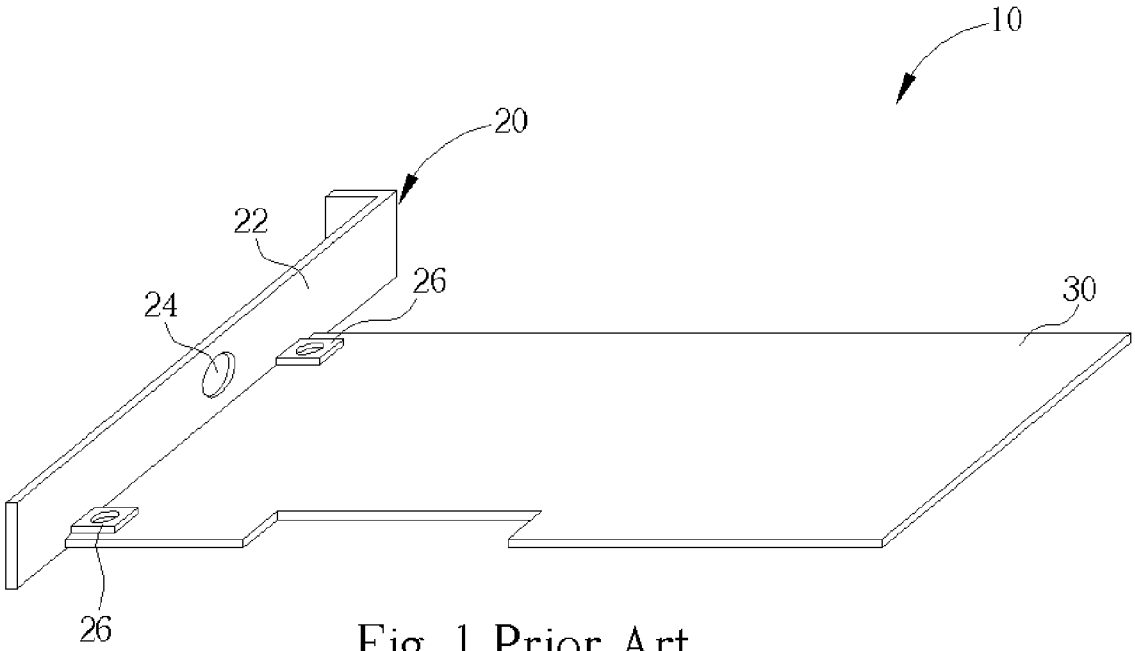
Fig. 1 Prior Art
FIG. 1 and FIG. 2 are diagrams of the prior art adapters.
Figure 2:
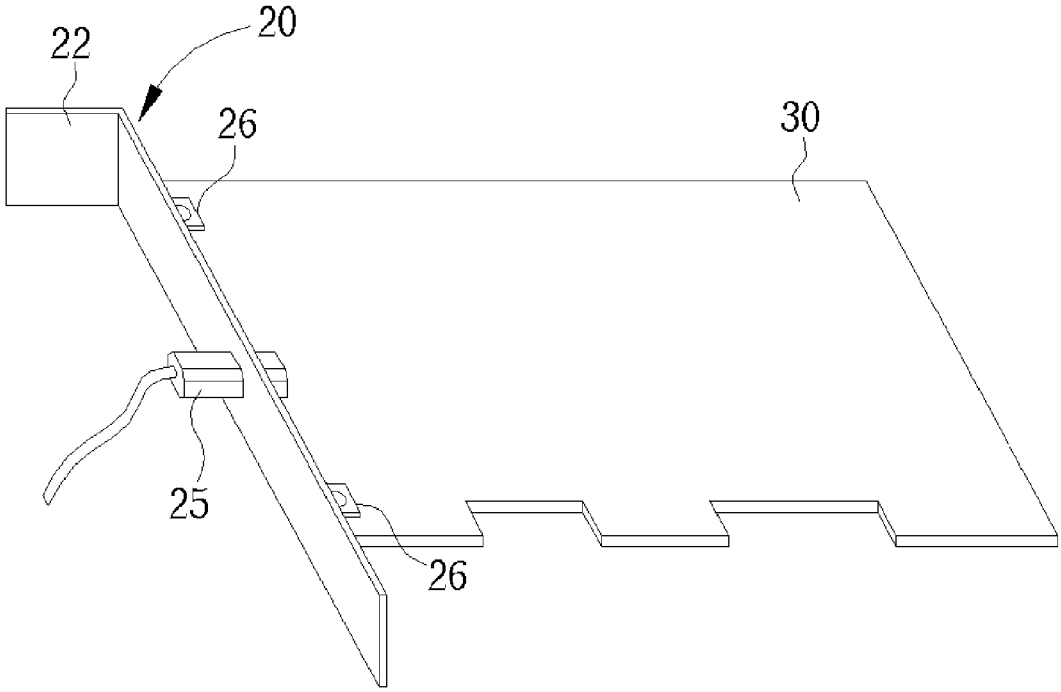
Fig. 2 Prior Art
Figure 3:
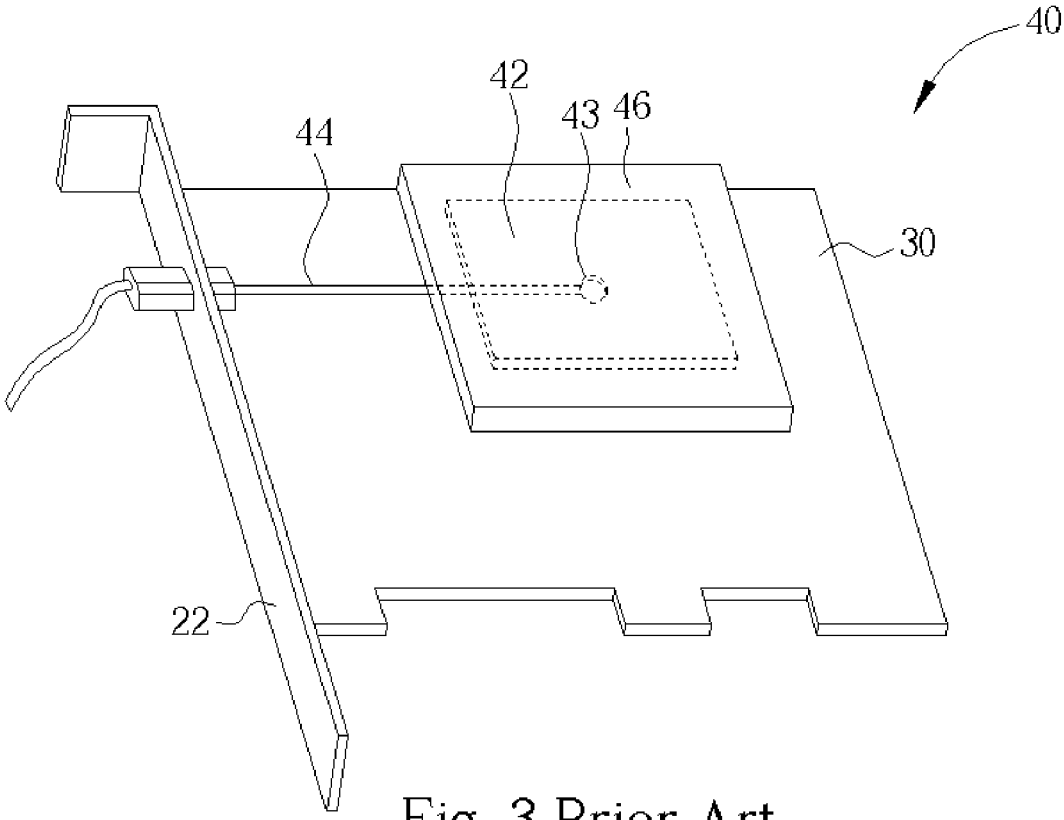
Fig. 3 Prior Art
FIG. 3 is a diagram of an adapter that has a mask on the wireless LAN card according to the prior art.

In the prior art, the antenna terminals of FIG. 1 and FIG. 2 can easily be taken off from the bracket 20. Therefore, the adapter 10 cannot use all the bandwidth of IEEE 802.11a. Although the connection 43 in FIG. 3 is hidden inside the mask 46 for preventing removal of the antenna, this increases the cost and wastes material. In contrast, the present invention allows use of all the bandwidth of IEEE 802.11a. The masks 68, 78, 88, and 98 requires small space for shielding the welded end 65 of the antenna terminal 63 on the wireless LAN card 30, rather than the space required for shielding the entire mini PCI 42. This can reduce the material requirements and the cost of the adapter 50. Additionally, the masks 68, 78, 88, and 98 are extended from the base plates 62, 72, 82, and 92, respectively. Thus, it is much easier to assemble the base plate 62, 72, 82, and 92 and the masks 68, 78, 88, and 98 on the wireless LAN card 30 for all wireless network adapters complying with FCC Part 15.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An adapter which can shield an end of an antenna terminal welded on a wireless LAN card, including:

a wireless LAN card; and a bracket fixed on the wireless LAN card, the bracket including:

a base plate having an aperture for positioning an antenna terminal; and a mask extended from the base plate for substantially shielding an end of the antenna terminal welded on the wireless LAN card inside the mask.

2. The adapter of claim 1 wherein the bracket further includes two fixing components extended from the base plate for firmly positioning the bracket on the wireless LAN card.

3. The adapter of claim 1 wherein the mask is shaped along with the base plate and extended from the base plate.

4. The adapter of claim 1 wherein the mask further includes a locating element for positioning the mask on the wireless network LAN card.

5. A bracket which can shield an end of an antenna terminal welded on a wireless LAN card, including:

a base plate having an aperture for positioning an antenna terminal; and a mask extended from the base plate for substantially shielding an end of the antenna terminal welded on the wireless LAN card inside the mask.

6. The bracket of claim 5 further including two fixing components extended from the base plate for firmly positioning the bracket on the wireless LAN card.

7. The bracket of claim 5 wherein the mask is shaped along with the base plate and extended from the base plate.

8. The bracket of claim 5 wherein the mask further includes a locating element for positioning the mask on the wireless LAN card.

* * * * *